US008079310B2

(12) United States Patent
Popjoy et al.

(10) Patent No.: US 8,079,310 B2
(45) Date of Patent: Dec. 20, 2011

(54) VERTICAL POSITION COMPENSATING DEVICE FOR A VEHICLE

(75) Inventors: Mark Alexander Popjoy, Lansdale, PA (US); Michael McGuinness, Warminster, PA (US)

(73) Assignee: LTK Consulting Services, Inc., Ambler, PA (US)

( * ) Notice: Subject to any disclaimer, the term of this patent is extended or adjusted under 35 U.S.C. 154(b) by 248 days.

(21) Appl. No.: 12/625,933

(22) Filed: Nov. 25, 2009

(65) Prior Publication Data

US 2011/0121526 A1 May 26, 2011

(51) Int. Cl.
*B61F 1/14* (2006.01)

(52) U.S. Cl. ..... 105/453; 105/199.1; 280/6.159

(58) Field of Classification Search .... 105/199.1–199.4, 105/453; 280/5.5, 5.514, 6.15, 6.151, 6.157, 280/6.159, 43.17–43.19, 43.23
See application file for complete search history.

(56) References Cited

U.S. PATENT DOCUMENTS

| | | | | |
|---|---|---|---|---|
| 2,883,179 | A | 4/1959 | Dean et al. | |
| 3,786,763 | A * | 1/1974 | Pollinger | 105/199.2 |
| 4,077,617 | A | 3/1978 | Wright | |
| 5,311,821 | A * | 5/1994 | Lang et al. | 105/199.2 |
| 5,588,367 | A | 12/1996 | Scheffel | |
| 5,588,368 | A | 12/1996 | Richter | |
| 5,746,134 | A | 5/1998 | Scheffel | |
| 5,947,031 | A | 9/1999 | Polley | |
| 6,102,378 | A | 8/2000 | Gieseler et al. | |
| 6,550,394 | B1 | 4/2003 | Polley | |
| 6,637,348 | B1 | 10/2003 | Teichmann et al. | |
| 7,168,370 | B2 | 1/2007 | Hommen et al. | |
| 7,185,592 | B2 | 3/2007 | Hommen et al. | |
| 7,243,606 | B2 | 7/2007 | Hommen et al. | |
| 2004/0016361 | A1 | 1/2004 | Teichmann et al. | |
| 2005/0183627 | A1 | 8/2005 | Hommen et al. | |
| 2005/0204951 | A1 | 9/2005 | Hommen et al. | |
| 2008/0210119 | A1 | 9/2008 | Lehmair et al. | |

FOREIGN PATENT DOCUMENTS

| | | | |
|---|---|---|---|
| JP | 54001517 A | * | 1/1979 |
| JP | 54120110 A | * | 9/1979 |
| JP | 05221315 A | * | 8/1993 |
| JP | 05221316 A | * | 8/1993 |

* cited by examiner

*Primary Examiner* — Joe Morano, IV
*Assistant Examiner* — Zachary Kuhfuss
(74) *Attorney, Agent, or Firm* — Ballard Spahr LLP

(57) ABSTRACT

A vertical position compensating device for a vehicle, a vehicle using the device, and a method for controlling the vertical position of a vehicle. The vehicle has a wheel set mounted on a chassis by a primary suspension system and a body mounted on the chassis through a secondary suspension system. The device is mounted on the body. As the vehicle is loaded or unloaded the device moves vertically with the body and also moves relative to the body in proportion to the deflection of the primary suspension system. The total motion of the device is used to adjust the vertical position of the body through the secondary suspension in a direction opposite to the deflection of the body to maintain the position of the body constant relative to a datum line.

48 Claims, 11 Drawing Sheets

VERTICAL POSITION COMPENSATING DEVICE FOR A VEHICLE

FIELD OF THE INVENTION

This invention relates to a device for controlling the vertical position of a vehicle, such as a railcar, relative to a datum line, such as a station platform, in response to changing loads on the vehicle.

BACKGROUND

Railway based passenger vehicles have used air spring secondary suspensions for a number of years. The secondary suspension provides vibration isolation for passengers and equipment in the car body, allowing for a comfortable ride. The air spring height is controlled through the use of a leveling valve which is so arranged that, as the passenger load of the vehicle changes, pressurized air is either admitted to or released from the air spring to maintain a constant air spring height, and thereby mitigate the change in car body height relative to a datum line. This is advantageous, for example, to mitigate the change in vehicle door threshold height relative to a fixed wayside platform that would otherwise occur due to air spring deflection.

Several different designs of air springs, such as rolling diaphragm and the convoluted air spring are widely available. Air springs typically have a nominal working height, with a design position range of between one and two inches. Leveling valves of various designs are also known in the art and typically use a mechanical linkage between the leveling valve and either the car body or truck, depending upon if the leveling valve is mounted to the truck or car body respectively, to control the relative height of the air spring when between the car body and the truck. As the air spring height changes, the linkage (also known as a sensing arm) causes a lever on the leveling valve to move in such a manner as to either increase the air spring pressure to compensate for an increasing load, or decrease the air spring pressure to compensate for a decreasing load, in either case restoring the original air spring height relative to its mounting. In some applications, air springs are mounted between a truck frame and truck bolster, and then the leveling valve is mounted between those two truck elements.

Railcars have a primary suspension which isolates the rail vehicle from track irregularities, and cushions the trucks and car body from the high forces generated at the wheel-rail interface. The primary suspension elements of railcars are typically rubber spring elements such as a chevron or a rolling rubber ring, or a steel coil spring either with a pedestal, radius arm or other guiding mechanism. Linear and non-linear primary suspension elements are used depending upon the design needs of the vehicle. In either case, the primary suspension is arranged to allow sufficient movement of the wheel sets for vertical wheel load equalization over track perturbations, provide a natural frequency generally less than 8 Hz, and perform other functions. Typical primary suspension deflection, depending upon the vehicle, is approximately 0.5 to 1 inch from the unloaded vehicle condition to the fully loaded vehicle condition.

In practice, car body height relative to a datum line is compensated for secondary suspension deflection, but not for primary suspension deflection. Hence, as it is desirable to maintain the vehicle passenger floor and threshold height in close alignment to the station platform to allow safe, efficient operation, and American with Disabilities Act conformance, the primary spring deflections should be compensated for, in addition to the secondary spring deflections.

Prior art teaches that primary and secondary suspension compensation can theoretically be obtained by mounting the leveling valve above the secondary suspension and connecting the leveling valve sensing arm to a link that communicates with a member that is below the primary suspension, such as the equalizing beam disclosed in U.S. Pat. No. 5,947,031 to Polley, which extends between the axle boxes of the truck wheel sets. However, due to mechanical issues created by truck rotation relative to the car body, and the high shock and vibration levels below the primary suspension, such embodiments are difficult to implement. The current invention eliminates the need for connecting to elements below the primary suspension, and provides a simple installation to allow new vehicles to be equipped with, or existing vehicles to be retrofitted with, a device which compensates for the deflection of both the primary and secondary suspension with changing passenger load.

SUMMARY

The invention concerns a compensating device for controlling a vertical position of a body mounted on a chassis of a vehicle relative to a datum line. The vehicle has a source of pressurized fluid, a plurality of wheels mounted on the chassis, a primary suspension positioned between the wheels and the chassis, and a fluid pressurized secondary suspension positioned between the chassis and the body. The compensating device comprises a chamber in fluid communication with the secondary suspension. A piston is positioned within the chamber. The piston and the chamber are movable relatively to one another. A biasing element is positioned between the piston and the chamber, preferably within the chamber.

A first and a second valve are mounted on either the piston or the chamber, the other of the piston or the chamber being mountable on the vehicle body. The first valve has an inlet in fluid communication with the source of pressurized fluid, and an outlet in fluid communication with the secondary suspension and the chamber. The second valve has an inlet in fluid communication with the secondary suspension and the chamber. The second valve also has an outlet.

An actuating mechanism extends between the first and second valves and the chassis. The actuating mechanism opens the first valve in response to motion of the body toward the chassis, and closes the first valve when the body is at a predetermined vertical position relative to the datum line. The actuating mechanism opens the second valve in response to motion of the body away from the chassis and closes the second valve when the body is at the predetermined vertical position relative to the datum line.

In one embodiment, the piston is mountable on the body and the first and second valves are mounted on the chamber. The biasing element is positioned so as to bias the chamber and the valves mounted thereon toward the body.

The cylinder, the piston and the biasing element are sized to effect motion of the chamber and the valves mounted thereon toward and away from the body in proportion to motion of the chassis on the primary suspension away from and toward the wheels respectively. In one embodiment, the motion of the chamber and the valves mounted thereon toward and away from the body is over a distance approximately equal to motion of the chassis on the primary suspension away from and toward the wheels respectively.

The compensating device according to the invention may be used on a railcar wherein the body comprises the railcar body and the chassis comprises the railcar truck. The truck may also include a bolster positioned between the truck and the secondary suspension.

The invention also encompasses a railcar, comprising a truck having a plurality of wheels, a car body mounted on the truck, a primary suspension positioned between the wheels and the truck, a secondary suspension positioned between the truck and the car body, and a source of pressurized fluid. Mounted on the car body is a compensating device for controlling a vertical position of the car body relative to a datum line such as a station platform.

The compensating device comprises a chamber in fluid communication with the secondary suspension, a piston positioned within the chamber, the piston and the chamber being movable relatively to one another, a biasing element positioned between the piston and the chamber. A first and a second valve are mounted on either the piston or the chamber, the other of the piston or the chamber being mounted on the car body. The first valve has an inlet in fluid communication with the source of pressurized fluid, and an outlet in fluid communication with the secondary suspension and the chamber. The second valve has an inlet in fluid communication with the secondary suspension and the chamber. The second valve also has an outlet.

An actuating mechanism extends between the first and second valves and the truck. The actuating mechanism opens the first valve in response to motion of the car body toward the truck, and closes the first valve when the car body is at a predetermined vertical position relative to the datum line. The actuating mechanism opens the second valve in response to motion of the car body away from the truck and closes the second valve when the car body is at the predetermined vertical position relative to the datum line.

In one embodiment the piston is mounted on the car body and the first and second valves are mounted on the chamber. The biasing element is positioned so as to bias the chamber and the valves mounted thereon toward the car body.

The piston and the biasing element may be sized to effect motion of the chamber and the valves mounted thereon toward and away from the car body in proportion to motion of the truck on the primary suspension away from and toward the wheels respectively. In one embodiment the motion of the chamber and the valves mounted thereon toward and away from the car body is over a distance approximately equal to motion of the truck on the primary suspension away from and toward the wheels respectively.

The railcar may also include a bolster positioned between the truck and the secondary suspension. The actuating mechanism comprises a lever extending between the first and second valves and the bolster.

The invention further encompasses a method of controlling a vertical position of a body mounted on a chassis of a vehicle relative to a datum line. The vehicle includes a plurality of wheels mounted on the chassis, a primary suspension positioned between the wheels and the chassis, and a fluid pressurized secondary suspension positioned between the chassis and the body. The method comprises:

(a) using a valve assembly, actuated by motion of the valve assembly, to control flow of a pressurized fluid to and from the secondary suspension of the vehicle to move the body relative to the chassis;
(b) moving the valve assembly along with the body on the secondary suspension relative to the chassis;
(c) moving the valve assembly relatively to the body in proportion to motion of the chassis on the primary suspension relative to the wheels;
(d) supplying the pressurized fluid to the secondary suspension through the valve assembly when the body is below the datum line; and
(e) venting the pressurized fluid from the secondary suspension though the valve assembly when the body is above the datum line.

More generally, the method may be described as:

(a) sensing a vertical motion of the body by moving a sensing device vertically along with the body;
(b) moving the sensing device vertically, relative to the body, over a distance proportional to a vertical deflection of the primary suspension system;
(c) sensing vertical motion of the sensing device over the distance proportional to the vertical deflection of the primary suspension system;
(d) deriving the deflection of the primary suspension system from the movement of the sensing device proportional to the vertical deflection of the primary suspension system; and
(e) moving the body vertically in an opposite direction to the vertical motion of the body through a distance approximately equal to the vertical motion of the sensing device along with the body, plus the vertical deflection of the primary suspension system.

DETAILED DESCRIPTION

Figure 1:
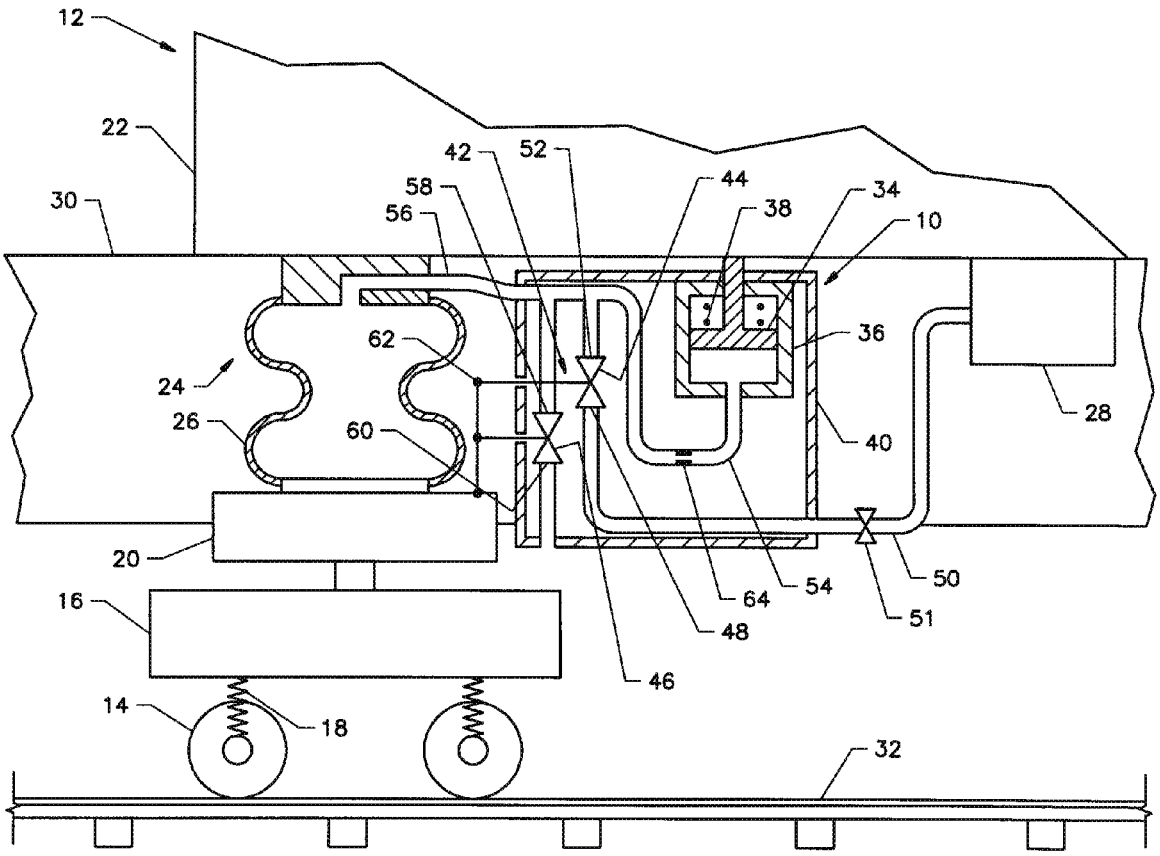
FIGS. 1, 2 and 3 are sectional schematic views of a railcar and a vertical position compensating device mounted thereon.

An example vertical position compensating device 10 according to the invention is shown schematically in FIG. 1. Compensating device 10 is shown being used in conjunction with a railcar 12, it being understood that the device could also be applied to other vehicles, such as omnibuses, automobiles, trucks and trailers, which have a primary suspension system and use a fluid pressurized secondary suspension system to isolate a body component from a chassis component supported on the primary suspension system.

Railcar 12 comprises a wheel set 14 mounted on a chassis 16 (commonly known as a truck) through a primary suspension system 18. A bolster 20 is mounted on the truck 16, the bolster being free to pivot relative to the truck about a vertical axis to permit the truck to rotate independently of a car body 22 mounted on the bolster. This articulation enables the railcar to negotiate curved track. The car body 22 in this example is mounted on bolster 20 by a secondary suspension 24 positioned between the car body and the bolster. Secondary suspension 24 serves to isolate the car body 22 from the truck 16, and comprises an air spring 26, for example a flexible bladder pressurized by a fluid, such as air. Railcar 12 also has a source of pressurized fluid 28, which may comprise, for example, a compressor and reservoir tanks which supply the pressurized air to the secondary suspension and other railcar systems, such as the air brakes (not shown).

Vertical position compensating device 10 is used to control the flow of compressed air to and from the secondary suspension system 24 in a manner which seeks to maintain a constant position of the car body 22 relative to a datum line 30. In this practical example the datum line 30 is a train station platform, and the device 10 is used to maintain the car body vertical position so as to keep the vehicle passenger floor and threshold height in close alignment with the platform 30 to allow for safe, efficient operation and thereby also comply with the American with Disabilities Act. Note that the choice of the datum line is arbitrary and could also be, for example, the height of the car body 22 above the track 32. The height of the car body relative to the platform will vary as passengers board and disembark from the train due to deflections of both the primary suspension system 18 and the secondary suspension system 24 in response to the changing passenger load on the railcar. Vertical position compensating device 10 accounts for the deflections of both the primary and secondary suspension systems when controlling the flow of fluid to and from the secondary suspension system to maintain a constant vertical position of the car body 22.

In the embodiment shown in FIG. 1, device 10 comprises a piston 34 mounted on the car body 22. The piston 34 is positioned within a chamber 36. The chamber is movable vertically relative to the car body 22 and consequently also the piston 34. The piston and chamber are in sealing relation to one another such that pressurized fluid applied to or bled from the chamber 36 will cause the chamber to move vertically relative to the piston. The chamber 36 is biased away from the car body 22 by a biasing element 38, for example a coil spring positioned within the chamber 36 between it and the piston. The area of the chamber 36 is sized in relation to the stiffness of the biasing element 38 to cause vertical motion of the chamber relative to the piston that is proportional to the vertical motion of the primary suspension system as it deflects under a changing load. To that end, the biasing element 38 and the chamber 36 may be designed to simulate a linear or a non-linear primary suspension as required for a particular application. The proportionality ratio between the motion of the chamber 36 and the deflection of the primary suspension may be equal to 1, meaning that the vertical motion of the chamber 36 is equal to the deflection of the truck on the primary suspension, or greater than 1, meaning that the motion of the chamber is greater than the motion of the truck on the primary suspension, or less than 1, meaning that the motion of the chamber is less than the motion of the truck on the primary suspension. A support frame 40 is attached to the chamber 36. This allows a valve assembly 42 to be mounted on the chamber 36 and move vertically with it relative to the car body 22 and the truck 16.

Valve assembly 42 is similar to leveling valves currently in use and may be thought of as comprising a first valve 44 and a second valve 46. First valve 44 has an inlet 48 in fluid communication with the source of pressurized fluid 28 through a flexible line 50. A cutoff valve 51 is provided in line 50 to allow the valve assembly 42 to be isolated from the source 28. First valve 44 also has an outlet 52 in fluid communication with the chamber 36 through a line 54 and also in fluid communication with the secondary suspension system 24 through a line 56. Second valve 46 has an inlet 58 in fluid communication with secondary suspension 24 through line 56 and an outlet 60 which vents to the atmosphere. An actuating mechanism 62, known as a sensing lever linkage, is connected between the valve assembly 42 (valves 44 and 46) and a portion of the truck 16 beneath the secondary suspension 24. In this example the sensing lever linkage 62 is attached to the bolster 20, but in railcars not using bolsters the linkage 62 is attached directly to the truck 16. The geometry of the sensing lever linkage is designed to cooperate with the vertical motion of the chamber 36 and ensure proper valve actuation to maintain the car body 22 at the desired vertical position. For a practical system design a flow restrictor 64, for example an orifice or choke, is positioned within line 54. This flow restrictor damps the response of the chamber 36 as it moves on piston 34 in response to air pressure changes within the device 10 during its operation as described below. The size of the restrictor is selected to ensure that the pressure in chamber 36 lags the pressure within the secondary suspension. This prevents over compensation and excess movement of the valve assembly 42 relative to the car body 22 and the truck 16, thereby controlling the actuation of valves 44 and 46 through the sensing lever linkage 62.

Figure 2:
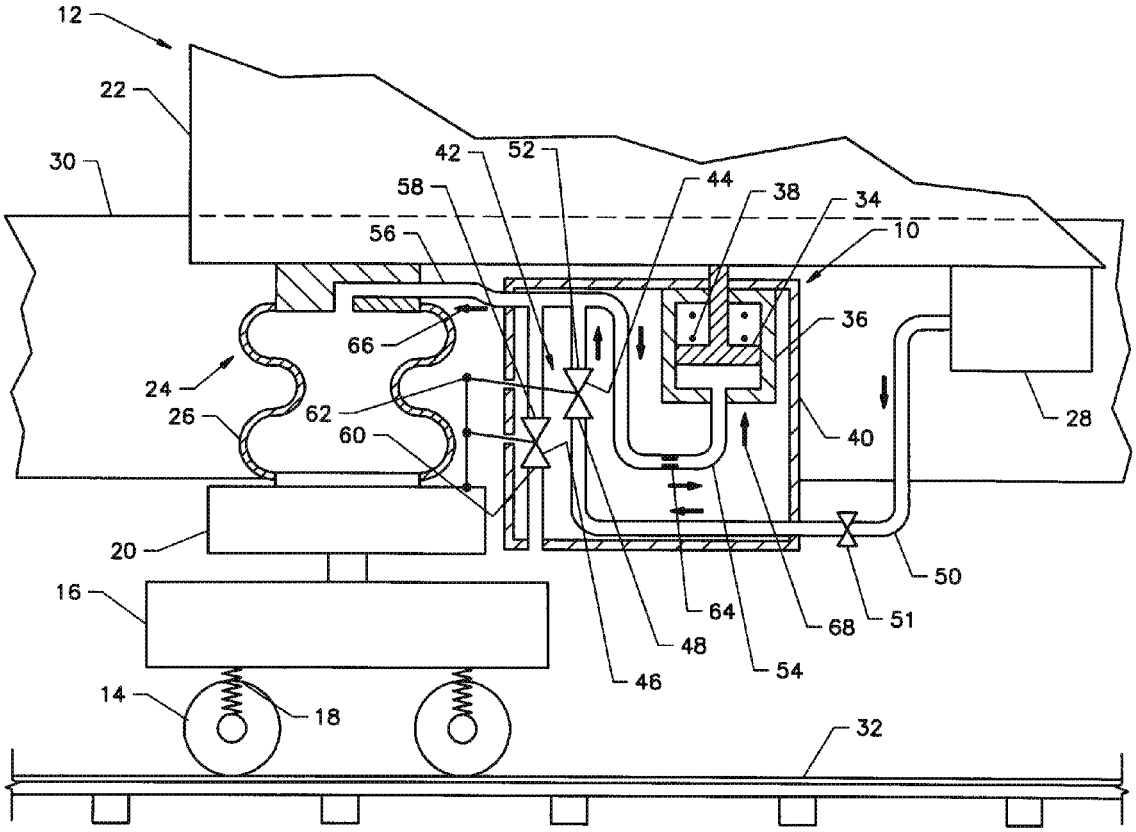
Figure 3:
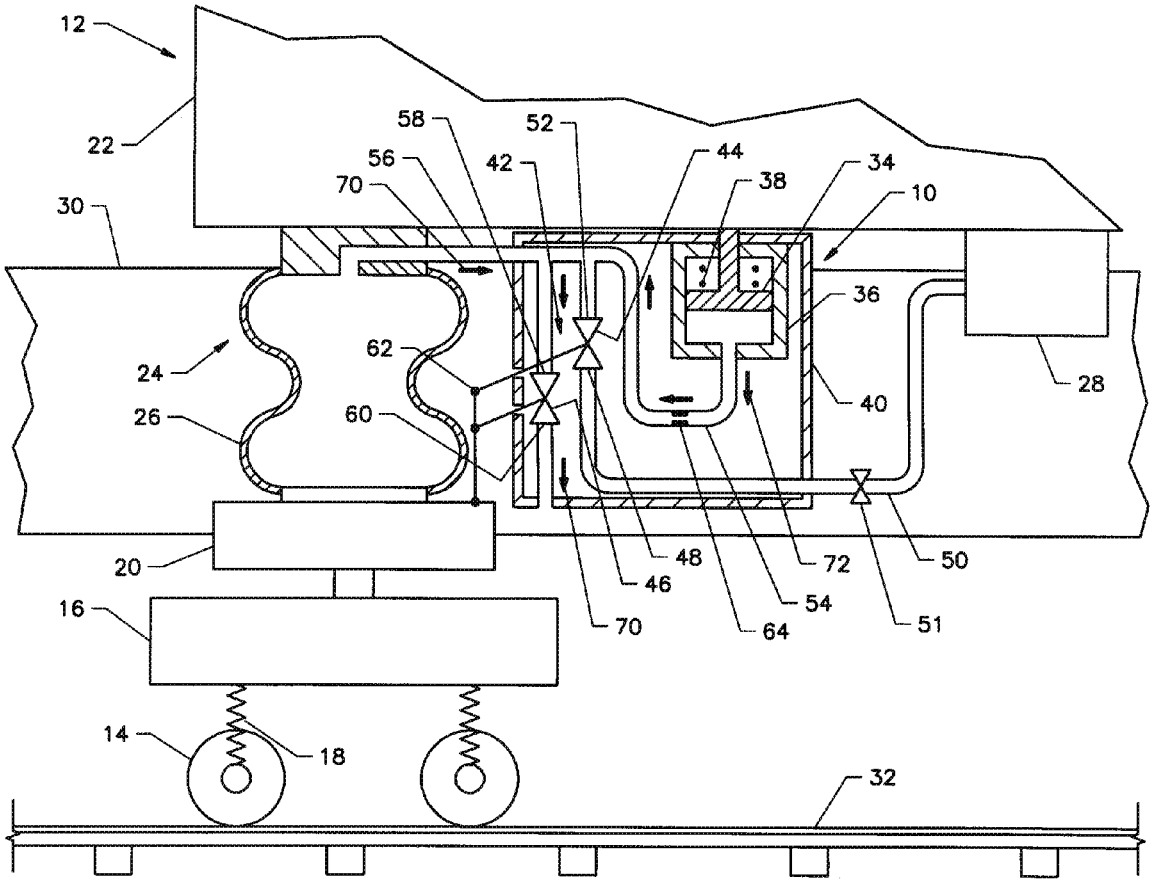

Operation of the vertical position compensating device 10 is described with reference to FIGS. 1-3. FIG. 1 shows the car body 22 at the desired position relative to the datum line 30, a wayside station platform for example. As shown in FIG. 2, the car body 22 moves downwardly and out of alignment with the platform 30 with the deflection of both the primary suspension 18 and the secondary suspension 24 as passengers (not shown) board the railcar 12. Device 10 initially moves downwardly along with the car body 22 on the secondary suspension 24. This causes the sensing lever linkage 62 to rotate upwardly relative to the downwardly moving valve assembly 42 which has the effect of opening the first valve 44 (the second valve 46 remains closed). Open valve 44 permits compressed air to enter the secondary suspension system 24 through line 56 as shown by arrows 66. This increases the pressure within the air springs 26 and raises the car body upwardly toward alignment with the platform 30. However, without additional compensation afforded by the device 10, the car body would be misaligned below the platform by the amount of the primary suspension system deflection. The additional compensation required occurs because opening valve 44 also permits compressed air to enter chamber 36 through line 54 as shown by arrows 68. The increase in pressure within chamber 36 causes it to move downwardly against the biasing force of biasing element 38 and relative to the car body 20. The extent of this additional downward motion is proportional to the downward deflection of the primary suspension system 18. In the present example we assume that the chamber and biasing element are designed so that the chamber moves a distance approximately equal to the deflection of the truck 16 on the primary suspension 18 due to the increase in pressure within the chamber. The valve assembly 42, being mounted on the chamber 36, also moves downwardly this additional increment. Thus the motion of the valves 44 and 46 is the sum of the motion of the car body 22 on the secondary suspension 24 and the motion of the chamber 36 relative to the car body 22, which is the same as the deflection of the truck on the primary suspension. The additional motion of the valves causes additional relative rotation of the sensing lever linkage 62, which permits additional compressed air to enter the secondary suspension 24. The increased pressure in the secondary suspension 24 raises the car body, and the valve assembly 42 rises with it. This causes a relative rotation of the sensing lever linkage 62 in the opposite direction, which eventually closes the first valve 44 when the car body 22 has moved upwardly a distance equal to the sum of the deflection of the primary and secondary suspension systems, and is again aligned with the platform 30 as shown in FIG. 1.

The device also compensates for misalignment between the car body 22 and the platform 30 when the car body moves above the level of the platform, as would occur when passengers disembark. As shown in FIG. 3, the car body 22 moves upwardly and out of alignment with the platform 30 with the deflection of both the primary suspension 18 and the secondary suspension 24 as passengers (not shown) disembark from the railcar 12. Device 10 initially moves upwardly along with the car body 22 on the secondary suspension 24. This causes the sensing lever linkage 62 to rotate downwardly relative to the upwardly moving valve assembly 42 which has the effect of opening the second valve 46 (the first valve 44 remains closed). Open valve 46 permits compressed air to escape from the secondary suspension system 24 to the atmosphere through line 56 and the outlet 60 of valve 46 as shown by arrows 70. This decreases the pressure within the air springs 26 and lowers the car body downwardly toward alignment with the platform 30. However, without additional compensation afforded by the device 10, the car body would be misaligned above the platform by the amount of the primary suspension system deflection. The additional compensation required occurs because opening valve 46 also permits compressed air to escape from chamber 36 through lines 54 and 56 as shown by arrows 72. The decrease in pressure within chamber 36 allows it to move upwardly in response to the biasing force of biasing element 38 and relative to the car body 22. The extent of this additional upward motion is proportional to the upward deflection of the primary suspension system 18. In the present example we again assume that the chamber and biasing element are designed so that the chamber moves a distance approximately equal to the deflection of the truck 16 on the primary suspension 18 due to the decrease in pressure within the chamber. The valve assembly 42, being mounted on the chamber 36, also moves upwardly this additional increment. Thus the motion of the valves 44 and 46 is the sum of the motion of the car body 22 on the secondary suspension 24 and the motion of the chamber 36 relative to the car body 22, which is the same as the deflection of the truck on the primary suspension. The additional motion of the valves causes additional relative rotation of the sensing lever linkage 62, which permits additional compressed air to escape from the secondary suspension 24. The decreased pressure in the secondary suspension 24 lowers the car body, and the valve assembly 42 descends with it. This causes a relative rotation of the sensing lever linkage 62 in the opposite direction, which eventually closes the second valve 46 when the car body 22 has moved downwardly a distance equal to the sum of the deflection of the primary and secondary suspension systems, and is again aligned with the platform 30 as shown in FIG. 1.

Figure 1A:
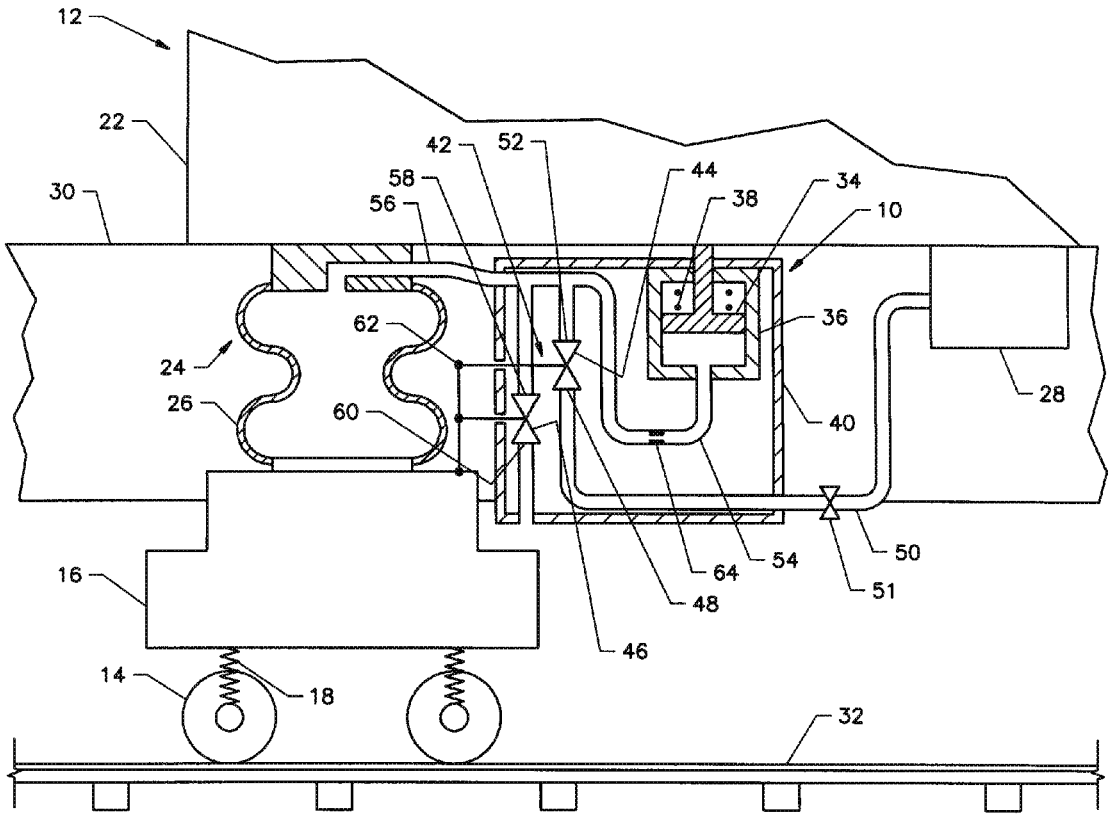
FIGS. 1A, 1B, 1C, 4 and 5 are sectional schematic views of a railcar and alternate embodiments of the vertical position compensating device.

FIG. 1A shows an alternate embodiment wherein the vertical position compensating device 10 according to the invention is used on a railcar 12 which has a truck 16 without a bolster. In this embodiment the piston 34 is again mounted on the car body 22 but the sensing lever linkage 62 is attached directly to the truck 16. Operation and effect of device 10 in this "bolsterless" configuration is substantially the same as described above with respect to FIGS. 1-3. It is noted that in practice, one of ordinary skill in the art would make provisions to compensate for the relative rotation between the truck 16 and the car body 22 when the railcar rounds a curve. This may be accomplished, for example, by a sliding attachment between the truck 16 and the sensing lever linkage 62, or by using ball joints in the linkage to provide the desired lateral flexibility while maintaining the vertical response of the sensing lever linkage required to actuate the vertical position compensating device 10.

Figure 1B:
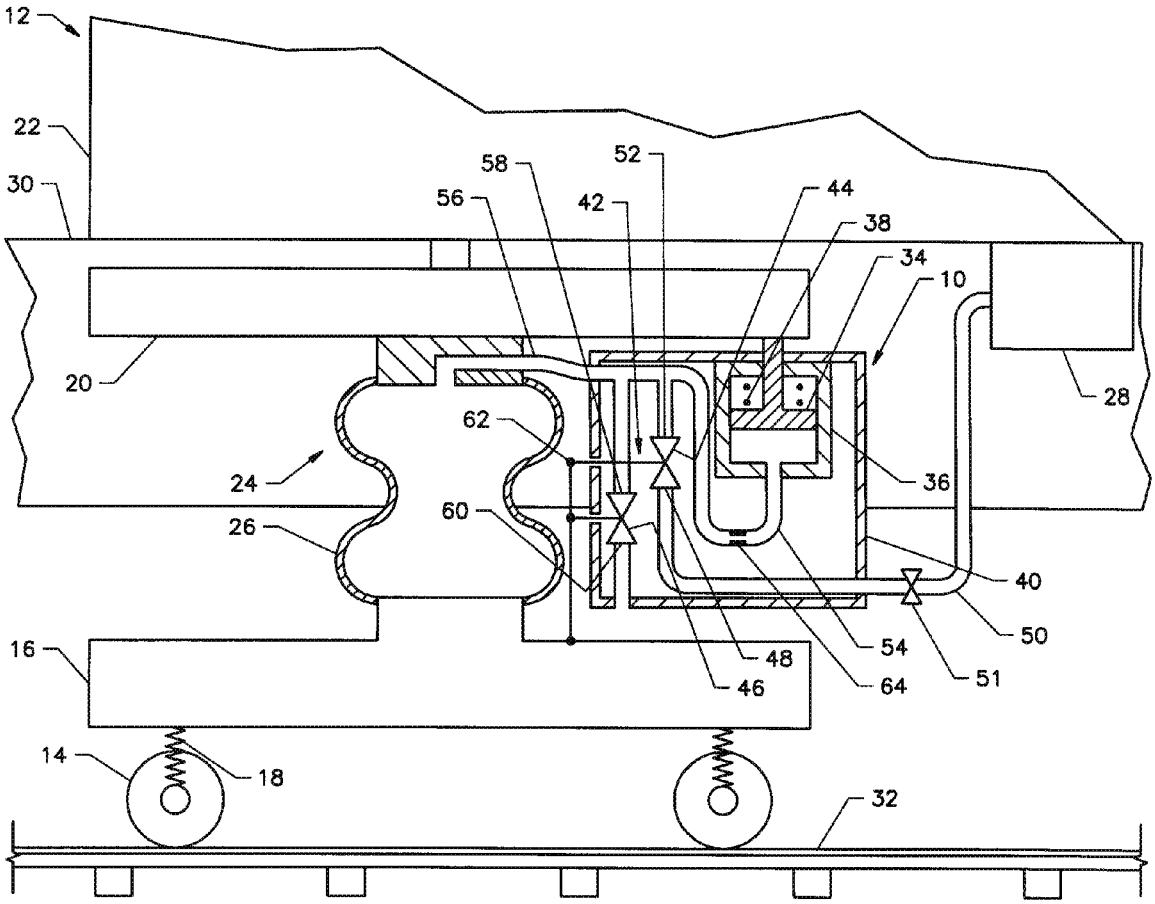

Another embodiment of the vertical position compensating device 10 is illustrated in FIG. 1B, wherein the secondary suspension 24 is positioned between the truck 16 and the bolster 20. Piston 34 is mounted on the bolster 20, which, for practical purposes is the same as mounting it on the car body 22 since, in this configuration both the bolster and the car body will have substantially identical vertical deflections. The sensing lever linkage 62 is again attached to the truck 16, and the device 10 will again operate as described above with respect to FIGS. 1-3. Note that this embodiment avoids the need to compensate for the relative rotation between the truck 16 and the car body 22 as the vertical position compensating device is not mounted on the car body per se but on the truck.

Figure 1C:
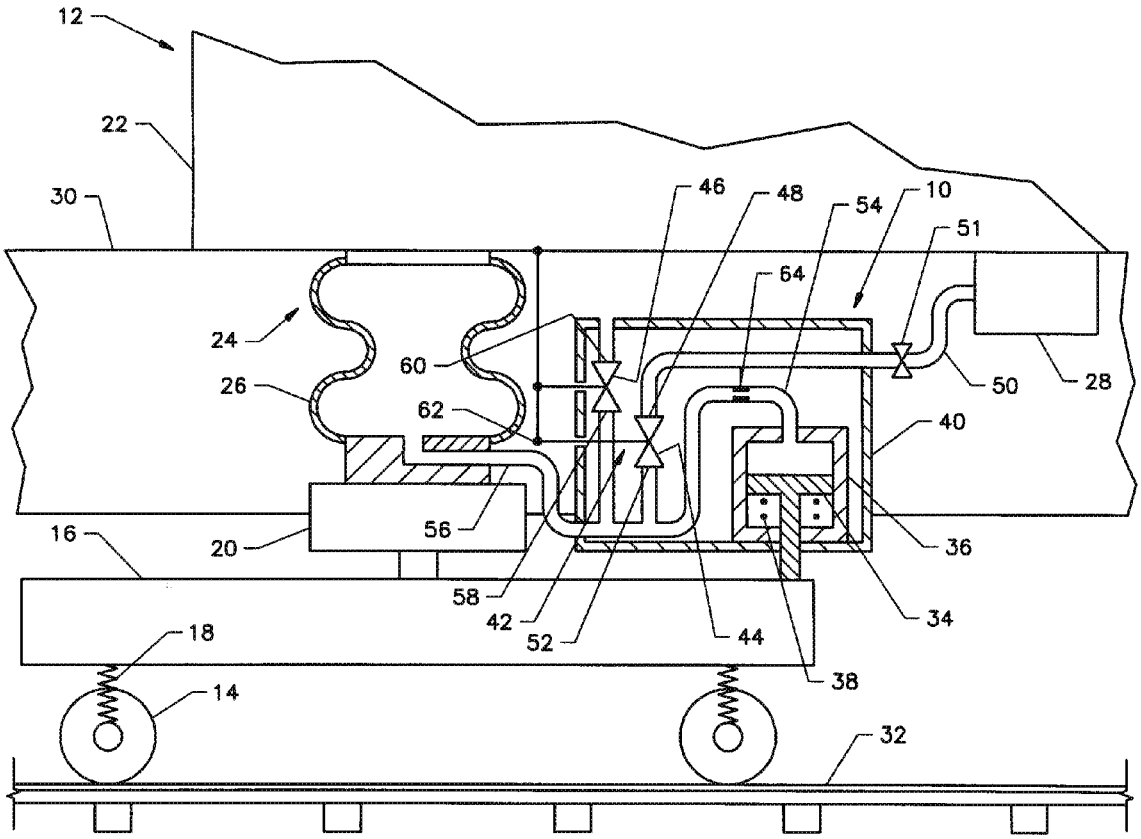

In the embodiment shown in FIG. 1C, the vertical position compensating device 10 is mounted on the truck 16, as shown wherein the piston 34 is attached directly to the truck. The sensing lever linkage 62 is attached to the car body 22. In this configuration the device 10 operates substantially as described above with respect to FIGS. 1-3 to control the vertical position of the railcar relative to a chosen datum line.

Figure 4:
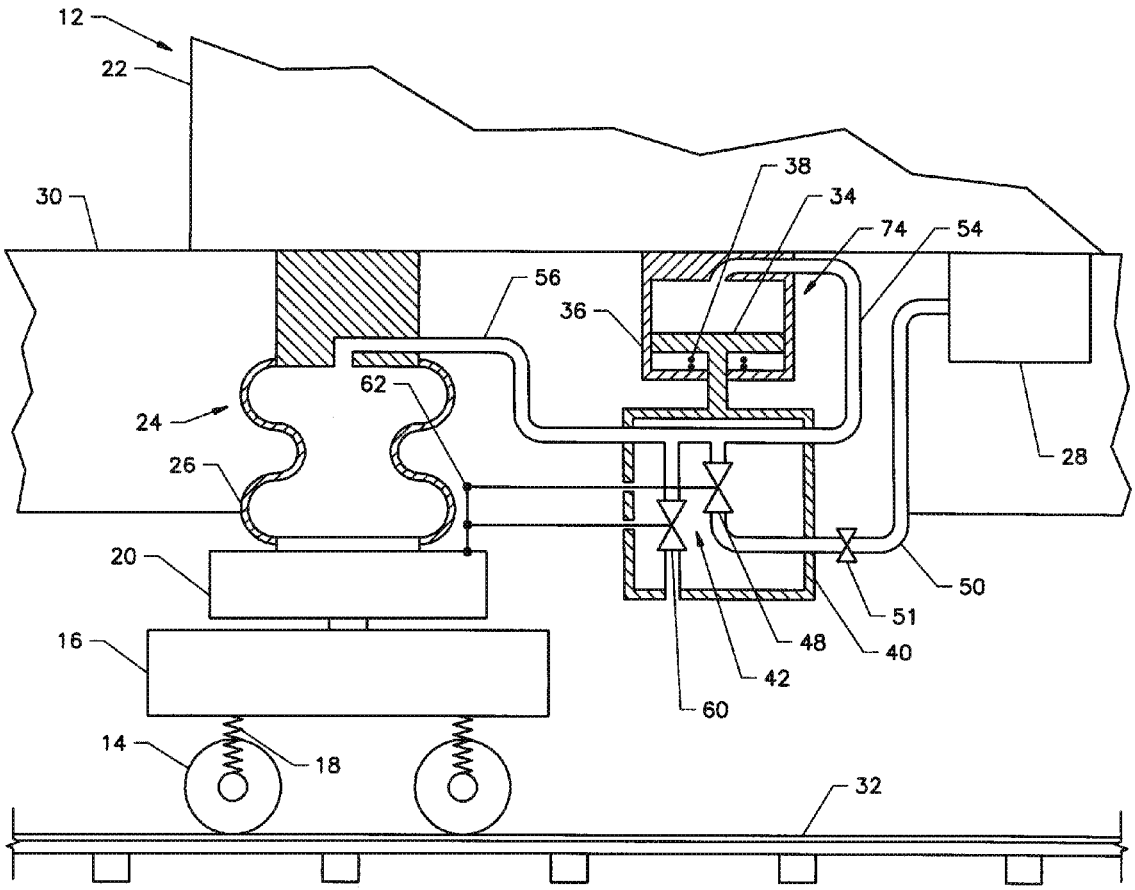

FIG. 4 shows an alternate embodiment 74 of the vertical position compensating device wherein the chamber 36 is fixedly mounted on the car body 22 and the valve assembly 42 is mounted on the piston 34 via the frame 40, the piston being movable relative to the car body in proportion to the motion of the truck on the primary suspension. The alternate embodiment 74 operates in the same manner as the embodiment described above.

Figure 5:
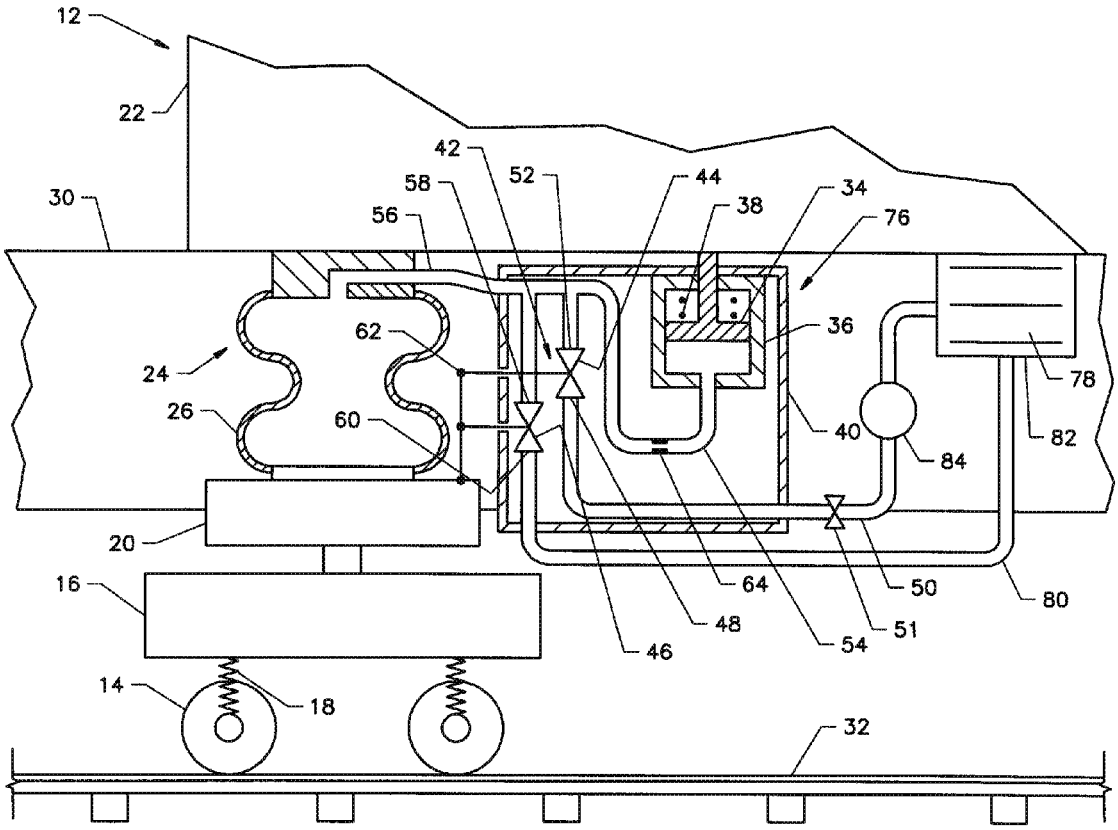

FIG. 5 illustrates another embodiment 76 of the vertical position compensating device wherein the pressurized fluid 78 is a liquid such as hydraulic fluid (oil). In this embodiment the outlet 60 of the second valve 46 is in fluid communication through a line 80 with a reservoir 82, for example, an oil sump, mounted on the car body 22. A hydraulic pump 84 in line 50 pumps the hydraulic fluid to the inlet 48 of first valve 44. This embodiment operates in substantially the same manner as described for the pneumatic system above.

Figure 6:
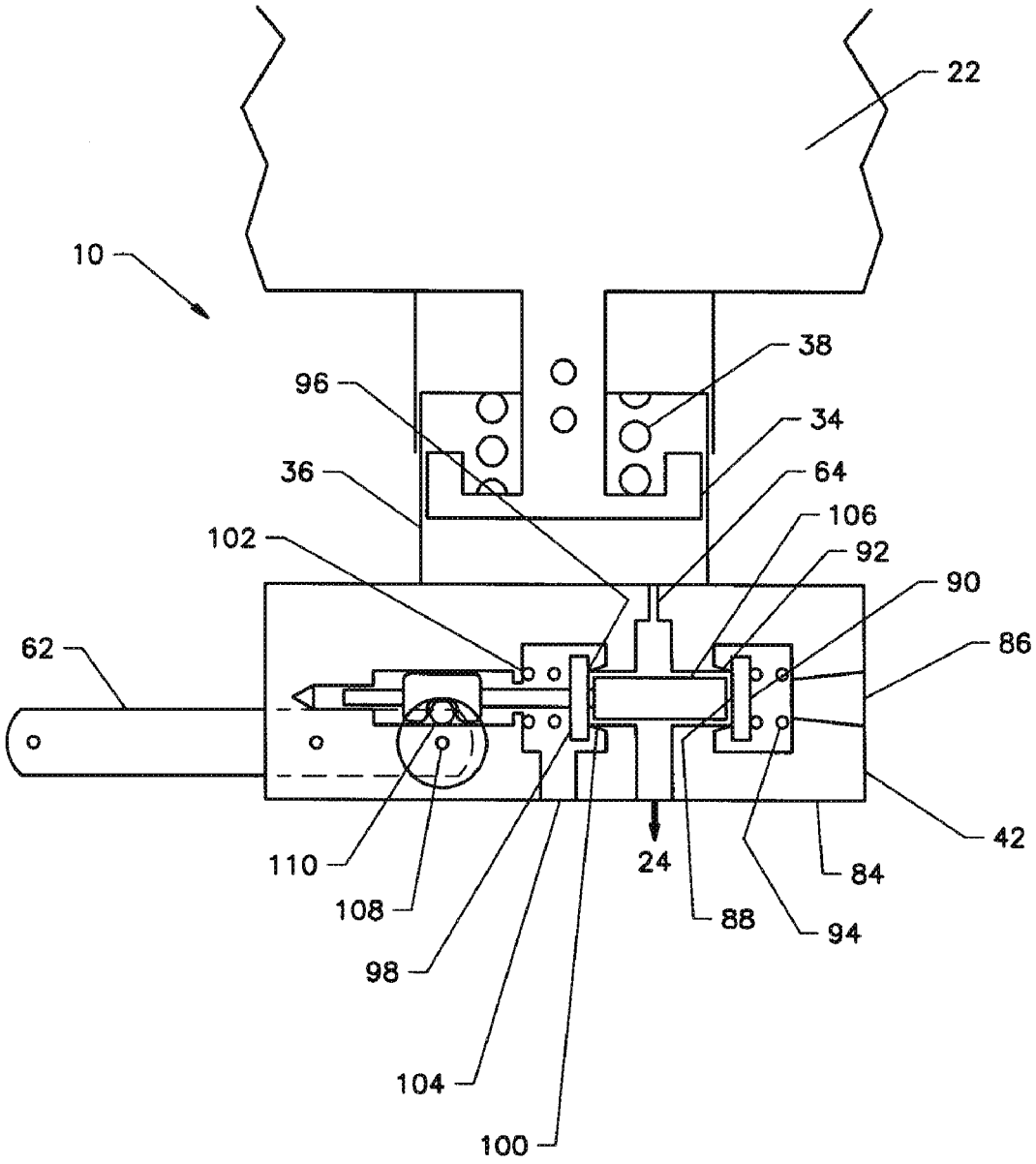
FIGS. 6 and 7 are sectional views of alternate embodiments of the vertical position compensating device shown in detail.

FIG. 6 shows an embodiment of the vertical position compensating device 10 in detail. In this embodiment, which incorporates a standard leveling valve 42 similar to Westcode WD 12375/001, the piston 34 is mounted on the car body 22, and the chamber 36 is movably mounted on the piston. Biasing element 38 is positioned within the chamber 36 and biases the chamber toward the car body 22. Design details, not shown for the sake of clarity but nevertheless advantageous in a practical design, include stops which limit the relative motion between the piston 34 and the chamber 36 to that of the primary suspension. Additionally, one or more locking pins may be used between the relatively moving parts, such as the chamber structure 36 and the piston 34 to allow the leveling valve 42 to be locked in the unloaded position to facilitate vehicle set-up or to deactivate the primary suspension compensation action. Furthermore, a vent valve can be arranged in line 54 (see FIG. 1) or on the valve 42 itself, which, when actuated, will block the flow of air from the secondary suspension to the chamber 36 and vent the compensating chamber to the atmosphere, thereby deactivating the compensation feature.

As noted above, the valving required for the device may be incorporated in a valve assembly 42. Valve assembly 42 is mounted on the chamber 36 and moves with it during operation as described above. The valve assembly comprises a housing 84 having an inlet 86 which is in fluid communication with the source of pressurized fluid 28 (not shown) and an outlet 88 which is in fluid communication with both the chamber 36 (through flow restrictor 64) and the secondary suspension 24 (shown schematically). A valve closing member 90 engages a seat 92 which surrounds the outlet 88. The valve closing member 90 opens and closes the outlet 88 to the source of pressurized fluid. The valve closing member 90 is biased into the closed position by a biasing element 94, for example, a coil spring located within the housing 84.

Another inlet 96 is positioned within the housing 84 and in fluid communication with chamber 36 (through flow restrictor 64) and the secondary suspension 24. Another valve closing member 98 engages a seat 100 which surrounds the inlet 96. The valve closing member 98 opens and closes the inlet 96 to the chamber 36 and the secondary suspension 24. The valve closing member 98 is biased into the closed position by a biasing element 102 located within the housing 84. Valve assembly 42 also has another outlet 104 which provides fluid communication between the inlet 96 and the atmosphere, permitting the chamber 36 and the secondary suspension 24 to be vented during operation of the device 10.

Valve closing members 90 and 98 are actuated by a rod 106 that slides within the housing 84. The closing members 90 and 98 are arranged on their respective seats 92 and 100 in opposition to one another such that when the rod 106 moves to the right with reference to FIG. 6, it slides through valve closing member 98 (which remains closed) but pushes valve closing member 90 off of its seat 92 against biasing element 94, allowing pressurized fluid to flow to chamber 36 and secondary suspension 24. Conversely, when rod 106 moves to the left with reference to FIG. 6, it disengages from valve closing member 90 (which is maintained in the closed position by biasing element 94) and draws the valve closing member 98 off of its seat 100, thereby providing fluid communication between chamber 36 and secondary suspension 24 and the atmosphere through outlet 104.

Rod 106 is linked to the sensing lever linkage 62 which in this example valve assembly is pivotably attached to the housing 84 and rotates about a pivot point 108 offset from the line of action of rod 106. Sensing lever linkage 62 is connected to rod 106 by a pivot joint 110 which converts the rotational motion of the lever 62 into linear motion of the rod. Rotation of the lever 62 in a clockwise sense will open the outlet 88 to the pressurized fluid source and charge the chamber 36 and secondary suspension 24 with pressurized fluid (condition as illustrated in FIG. 2). Rotation of the lever 62 in a counterclockwise sense will open the inlet 96 and vent the chamber 36 and the secondary suspension 24 to the atmosphere (condition as illustrated in FIG. 3).

Figure 7:
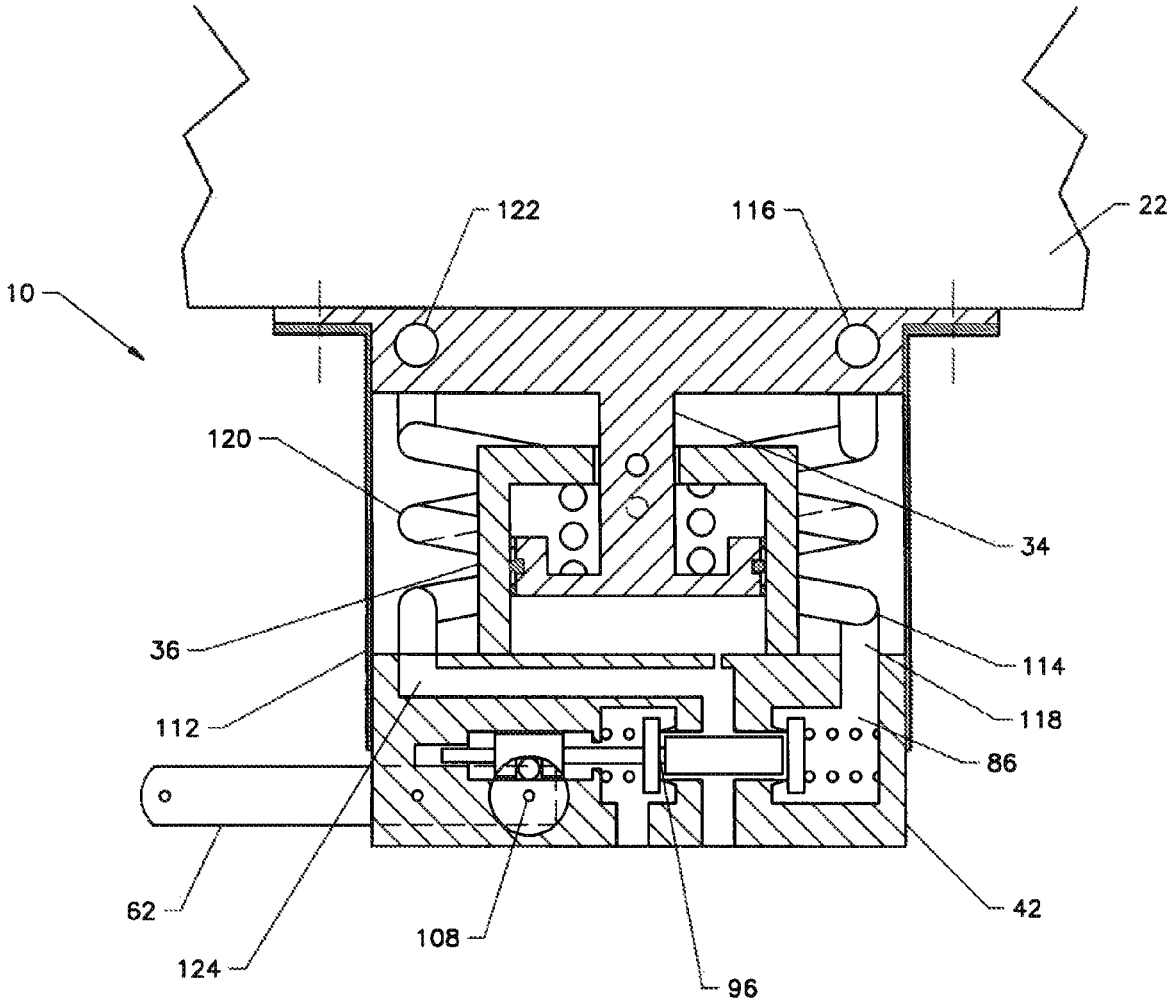

FIG. 7 shows a compact, practical design of a vertical position compensating device 10 according to the invention which can be readily mounted on a railcar, either during original manufacture or as a retro-fit to an existing car. In this embodiment the valve assembly 42 (shown in FIG. 6) is positioned within a protective shroud 112 mounted on the car body 22. Valve assembly 42 is mounted on chamber 36 which moves in relation to piston 34, the piston being rigidly mounted to the car body 22. A duct 114 is also positioned within the protective shroud 112. Duct 114 has an inlet 116 connectable with the source of pressurized fluid 28 (not shown) and an outlet 118 in fluid communication with the inlet 86 of the valve assembly 42. Another duct 120 is positioned within the protective shroud 112. Duct 120 has an inlet 122 in fluid communication with the secondary suspension 24 (not shown) and an outlet 124 in fluid communication with the chamber 36 and the inlet 96 of the valve assembly 42. With the ducts 114 and 120 providing fluid communication as described above and shown in FIG. 7, the vertical position compensating device 10 will operate as described above to control the height of the car body 22 above a datum line, taking the deflections of both the primary and secondary suspensions into account. Ducts 114 and 120 may be, for example, flexible hoses or articulated rigid lines.

Figure 8:
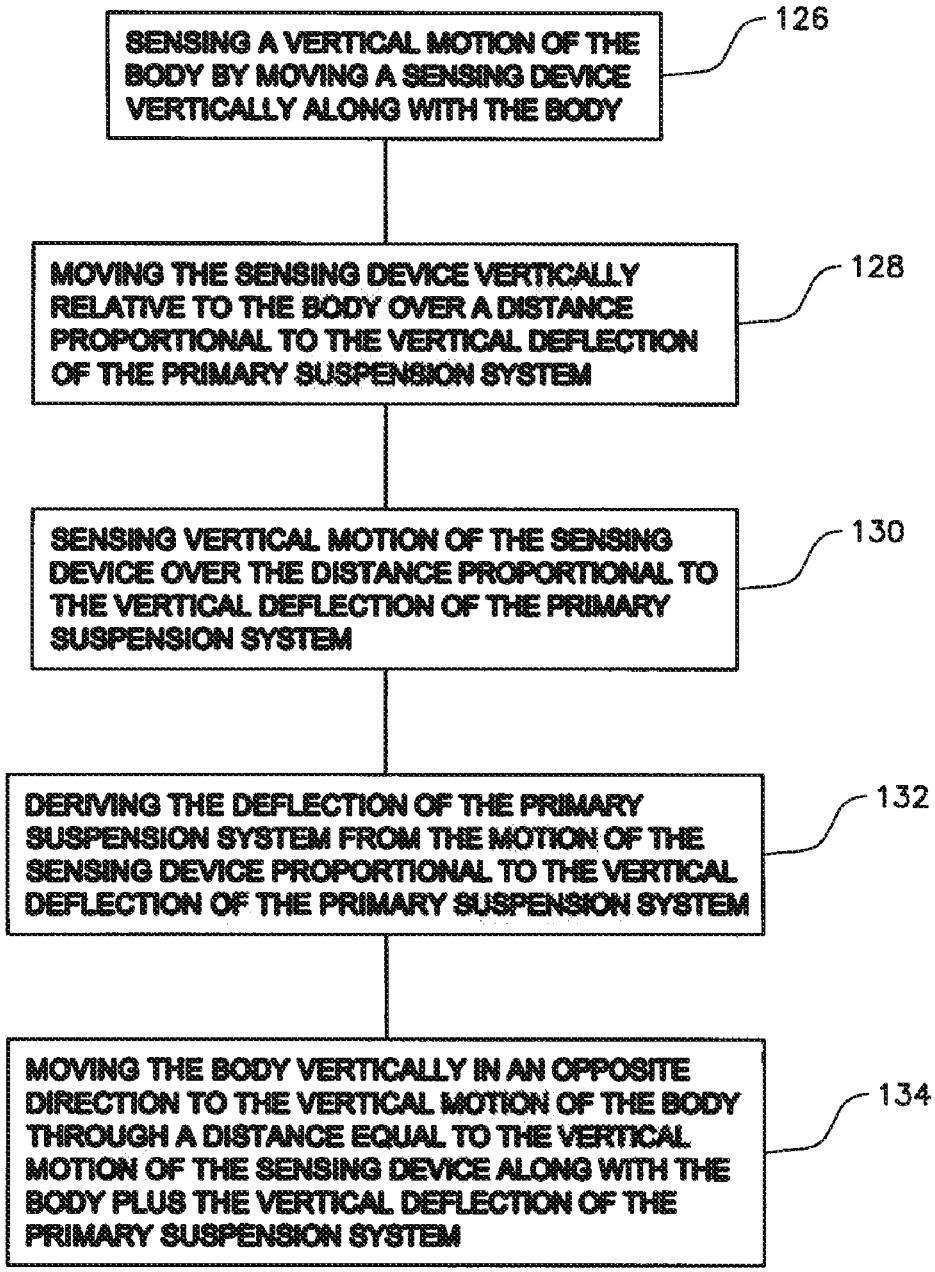
FIG. 8 is a flow diagram illustrating a method of controlling the height of a body according to the invention.

FIG. 8 shows a flow diagram which illustrates the method of controlling the vertical position of a body relative to a datum line according to the invention. The body could be that of a vehicle supported on a wheel set by a chassis having a primary suspension between the wheel set and the chassis and a secondary suspension between the body and the chassis.

As shown in box 126, one step comprises sensing a vertical motion of the body by moving a sensing device vertically along with the body. Device 10, described above, can be considered the sensing device referenced in this step. As described above, when mounted on the car body 22, device 10 moves vertically with it as the load on the car body changes. The pivoting motion of the sensing lever linkage 62 constitutes a sensing of the vertical motion of the car body 22, as the angular displacement of the lever is directly proportional to this vertical deflection.

Another step, shown in box 128, comprises moving the sensing device vertically, relative to the body, over a distance proportional to a vertical deflection of the primary suspension system. This step occurs when chamber 36 is pressurized or depressurized, causing it to move relatively to piston 34. As noted above, the piston, chamber and the biasing element 38 are designed so that the vertical movement of the device 10 relative to the car body 22 is proportional to the vertical deflection of the primary suspension. The simple case is when the relative motion of device 10 relative to the car body 22 is approximately equal to the vertical deflection of the primary suspension.

Another step, referenced in box 130, comprises sensing vertical motion of the sensing device over the distance proportional to the vertical deflection of the primary suspension system. The pivoting motion of the sensing lever linkage 62 constitutes a sensing of the vertical motion of the sensing device (device 10), as the additional angular displacement of the lever caused by the motion of device 10 relative to the car body 22 is directly proportional to this vertical deflection.

Another step comprises deriving the deflection of the primary suspension system from the movement of the sensing device proportional to the vertical deflection of the primary suspension system. This derivation is trivial if the piston 34, chamber 36 and biasing element 38 are designed to move the device over a vertical distance approximately equal to the vertical deflection of the primary suspension system. In this case the additional angular displacement of the sensing lever linkage 62 is directly proportional to the deflection of the primary suspension system, and the derivation of the deflection of the of the primary suspension system is provided directly by the angular displacement of the sensing lever linkage. Therefore, we can conclude that motion of the car body 22 in an opposite direction to the motion of the sensor, which causes the sensing lever linkage to rotate through the same angular displacement in the opposite direction, will bring the car body back to its desired position relative to the datum line. This information is used in the next step, shown in box 134, moving the body vertically in an opposite direction to the vertical motion of the body through a distance approximately equal to the vertical motion of the sensing device along with the body, plus the vertical deflection of the primary suspension system.

What is claimed is:

1. A compensating device for controlling a vertical position of a body mounted on a chassis of a vehicle relative to a datum line, said vehicle having a source of pressurized fluid, a plurality of wheels mounted on said chassis, a primary suspension positioned between said wheels and said chassis, and a fluid pressurized secondary suspension positioned between said chassis and said body, said compensating device comprising:

a chamber in fluid communication with said secondary suspension;

a piston positioned within said chamber, said piston and said chamber being movable relatively to one another;

a biasing element positioned between said piston and said chamber;

a first and a second valve mounted on one of said piston and said chamber, the other of said piston and said chamber being mountable on said body, said first valve having an inlet in fluid communication with said source of pressurized fluid, and an outlet in fluid communication with said secondary suspension and said chamber, said second valve having an inlet in fluid communication with said secondary suspension and said chamber, said second valve also having an outlet;

an actuating mechanism extending between said first and second valves and said chassis, said actuating mechanism opening said first valve in response to motion of said body toward said chassis, said actuating mechanism closing said first valve when said body is at a predetermined vertical position relative to said datum line, said actuating mechanism opening said second valve in response to motion of said body away from said chassis and closing said second valve when said body is at said predetermined vertical position relative to said datum line.

2. The compensating device according to claim 1, wherein said piston is mountable on said body and said first and second valves are mounted on said chamber, said biasing element being positioned so as to bias said chamber and said valves mounted thereon toward said body.

3. The compensating device according to claim 2, wherein said cylinder, said piston and said biasing element are sized to effect motion of said chamber and said valves mounted thereon toward and away from said body in proportion to motion of said chassis on said primary suspension away from and toward said wheels respectively.

4. The compensating device according to claim 2, wherein said cylinder, said piston and said biasing element are sized to effect motion of said chamber and said valves mounted thereon toward and away from said body over a distance approximately equal to motion of said chassis on said primary suspension away from and toward said wheels respectively.

5. The compensating device according to claim 1, wherein said biasing element comprises a coil spring.

6. The compensating device according to claim 1, wherein said biasing element is positioned within said chamber.

7. The compensating device according to claim 1, wherein said pressurized fluid comprises air and said outlet of said second valve is in fluid communication with the atmosphere.

8. The compensating device according to claim 1, wherein said pressurized fluid is a liquid, said device further comprising:

a reservoir in fluid communication with said outlet of said second valve;

a pump having an inlet in fluid communication with said reservoir and an outlet in fluid communication with said inlet of said first valve.

9. The compensating device according to claim 1, further comprising:

a conduit providing fluid communication between said chamber and said secondary suspension, said conduit comprising a flow restrictor positioned so as to restrict the flow of said fluid between said chamber and said secondary suspension.

10. The compensating device according to claim 1, further comprising:

a conduit providing fluid communication between said chamber and said secondary suspension, said conduit comprising a flow restrictor positioned so as to restrict the flow of said fluid between said chamber and said secondary suspension and said outlet of said first valve.

11. The compensating device according to claim 1, further comprising:

a conduit providing fluid communication between said chamber and said secondary suspension, said conduit comprising a flow restrictor positioned so as to restrict the flow of said fluid between said chamber and said secondary suspension and said inlet of said second valve.

12. The compensating device according to claim 1, wherein said vehicle comprises a railcar, said body comprises a railcar body, said chassis comprises a rail truck including a bolster mounted on said truck and positioned between said truck and said secondary suspension, said actuating mechanism comprising a lever extending between said first and second valves and said bolster.

13. The compensating device according to claim 1, wherein said chamber is mountable on said body and said first and second valves are mounted on said piston, said biasing element being positioned so as to bias said piston and said valves mounted thereon toward said body.

14. The compensating device according to claim 2, further comprising:

a shroud mountable on said body, said shroud surrounding said chamber, said piston and said first and second valves;

a first duct positioned within said shroud, said first duct having a first duct inlet connectable in fluid communication with said source of pressurized fluid and a first duct outlet in fluid communication with said inlet of said first valve;

a second duct positioned within said shroud, said second duct having a second duct inlet in fluid communication with said secondary suspension and a second duct outlet in fluid communication with said inlet of said second valve and said chamber.

15. The compensating device according to claim, 14, further comprising a flow restrictor positioned between said chamber and said second duct outlet.

16. A compensating device for controlling a vertical position of a car body of a railcar relative to a datum line, said railcar having a source of pressurized fluid, a truck with a plurality of wheels, a primary suspension positioned between said wheels and said truck, and a fluid pressurized secondary suspension positioned between said truck and said car body, said compensating device comprising:

a chamber in fluid communication with said secondary suspension;

a piston positioned within said chamber, said piston and said chamber being movable relatively to one another;

a biasing element positioned between said piston and said chamber;

a valve assembly mounted on one of said piston and said chamber, the other of said piston and said chamber being mounted on said car body, said valve assembly having a first inlet in fluid communication with said source of pressurized fluid, a first outlet in fluid communication with said secondary suspension and said chamber, a second inlet in fluid communication with said secondary suspension and said chamber, and a second outlet;

an actuating mechanism extending between said valve assembly and said truck, said actuating mechanism opening said valve assembly to permit fluid communication between said pressurized source of fluid and said chamber and said secondary suspension in response to motion of said car body toward said truck, and closing said valve assembly to prevent fluid communication between said source of pressurized fluid and said chamber and said secondary suspension when said car body is at a predetermined vertical position relative to said datum line, said actuating mechanism opening said valve assembly to permit fluid communication between said second outlet and said secondary suspension and said chamber in response to motion of said car body away from said truck and closing said valve assembly to prevent fluid communication between said second outlet and said secondary suspension and said chamber when said car body is at said predetermined vertical position relative to said datum line.

17. The compensating device according to claim 16, wherein said piston is mounted on said car body and said valve assembly is mounted on said chamber, said biasing element being positioned so as to bias said chamber and said valve assembly mounted thereon toward said car body.

18. The compensating device according to claim 17, wherein said cylinder, said piston and said biasing element are sized to effect motion of said chamber and said valve assembly mounted thereon toward and away from said car body in proportion to motion of said truck on said primary suspension away from and toward said wheels respectively.

19. The compensating device according to claim 17, wherein said cylinder, said piston and said biasing element are sized to effect motion of said chamber and said valve assembly mounted thereon toward and away from said car body over a distance approximately equal to motion of said truck on said primary suspension away from and toward said wheels respectively.

20. The compensating device according to claim 16, wherein said biasing element comprises a coil spring.

21. The compensating device according to claim 16, wherein said biasing element is positioned within said chamber.

22. The compensating device according to claim 16, wherein said pressurized fluid comprises air and said second outlet is in fluid communication with the atmosphere.

23. The compensating device according to claim 16, wherein said pressurized fluid is a liquid, said device further comprising:

a reservoir in fluid communication with said second outlet;

a pump having a pump inlet in fluid communication with said reservoir and a pump outlet in fluid communication with said first inlet.

24. The compensating device according to claim 16, further comprising:

a conduit providing fluid communication between said chamber and said secondary suspension, said conduit comprising a flow restrictor positioned so as to restrict the flow of said fluid between said chamber and said secondary suspension.

25. The compensating device according to claim 16, further comprising:

a conduit providing fluid communication between said chamber and said secondary suspension, said conduit comprising a flow restrictor positioned so as to restrict the flow of said fluid between said chamber and said secondary suspension and said first outlet.

26. The compensating device according to claim 16, further comprising:

a conduit providing fluid communication between said chamber and said secondary suspension, said conduit comprising a flow restrictor positioned so as to restrict the flow of said fluid between said chamber and said secondary suspension and said second inlet.

27. The compensating device according to claim 16, wherein said railcar further comprises a bolster positioned between said truck and said secondary suspension, said actuating mechanism comprising a lever extending between said valve assembly and said bolster.

28. The compensating device according to claim 16, wherein said chamber is mounted on said car body and said valve assembly is mounted on said piston, said biasing element being positioned so as to bias said piston and said valve assembly mounted thereon toward said car body.

29. The compensating device according to claim 17, further comprising:

a shroud mountable on said car body, said shroud surrounding said chamber, said piston and said valve assembly;

a first duct positioned within said shroud, said first duct having a first duct inlet connectable in fluid communication with said source of pressurized fluid, and a first duct outlet in fluid communication with said first inlet of said valve assembly;

a second duct positioned within said shroud, said second duct having a second duct inlet in fluid communication with said secondary suspension and a second duct outlet in fluid communication with said second inlet of said valve assembly and said chamber.

30. The compensating device according to claim, 29, further comprising a flow restrictor positioned between said chamber and said second duct outlet.

31. A railcar, comprising:

a truck having a plurality of wheels;

a car body mounted on said truck;

a primary suspension positioned between said wheels and said truck;

a fluid pressurized secondary suspension positioned between said truck and said car body;

a source of pressurized fluid;

a compensating device for controlling a vertical position of said car body relative to a datum line, said compensating device comprising:

a chamber in fluid communication with said secondary suspension;

a piston positioned within said chamber, said piston and said chamber being movable relatively to one another;

a biasing element positioned between said piston and said chamber;

a first and a second valve mounted on one of said piston and said chamber, the other of said piston and said chamber being mounted on said car body, said first valve having an inlet in fluid communication with said source of pressurized fluid, and an outlet in fluid communication with said secondary suspension and said chamber, said second valve having an inlet in fluid communication with said secondary suspension and said chamber, said second valve also having an outlet;

an actuating mechanism extending between said first and second valves and said truck, said actuating mechanism opening said first valve in response to motion of said car body toward said truck, said actuating mechanism closing said first valve when said car body is at a predetermined vertical position relative to said datum line, said actuating mechanism opening said second valve in response to motion of said car body away from said truck and closing said second valve when said car body is at said predetermined vertical position relative to said datum line.

32. The railcar according to claim 31, wherein said piston is mounted on said car body and said first and second valves are mounted on said chamber, said biasing element being positioned so as to bias said chamber and said valves mounted thereon toward said car body.

33. The railcar according to claim 32, wherein said cylinder, said piston and said biasing element are sized to effect motion of said chamber and said valves mounted thereon toward and away from said car body in proportion to motion of said truck on said primary suspension away from and toward said wheels respectively.

34. The railcar according to claim 32, wherein said cylinder, said piston and said biasing element are sized to effect motion of said chamber and said valves mounted thereon toward and away from said car body over a distance approximately equal to motion of said truck on said primary suspension away from and toward said wheels respectively.

35. The railcar according to claim 31, further comprising a bolster positioned between said truck and said secondary suspension, said actuating mechanism comprising a lever extending between said first and second valves and said bolster.

36. The railcar according to claim 32, further comprising:

a shroud mounted on said car body, said shroud surrounding said chamber, said piston and said first and second valves;

a first duct positioned within said shroud, said first duct having a first duct inlet connected in fluid communication with said source of pressurized fluid and a first duct outlet in fluid communication with said inlet of said first valve;

a second duct positioned within said shroud, said second duct having a second duct inlet in fluid communication with said secondary suspension and a second duct outlet in fluid communication with said inlet of said second valve and said chamber.

37. A railcar, comprising:

a truck having a plurality of wheels;

a car body;

a primary suspension positioned between said wheels and said truck;

a fluid pressurized secondary suspension positioned between said truck and said car body;

a source of pressurized fluid;

a compensating device for controlling a vertical position of said car body relative to a datum line, said compensating device comprising:

a chamber in fluid communication with said secondary suspension;

a piston positioned within said chamber, said piston and said chamber being movable relatively to one another;

a biasing element positioned between said piston and said chamber;

a valve assembly mounted on one of said piston and said chamber, the other of said piston and said chamber being mounted on said car body, said valve assembly having a first inlet in fluid communication with said source of pressurized fluid, a first outlet in fluid communication with said secondary suspension and said chamber, a second inlet in fluid communication with said secondary suspension and said chamber, and a second outlet;

an actuating mechanism extending between said valve assembly and said truck, said actuating mechanism opening said valve assembly to permit fluid communication between said pressurized source of fluid and said chamber and said secondary suspension in response to motion of said car body toward said truck, and closing said valve assembly to prevent fluid communication between said source of pressurized fluid and said chamber and said secondary suspension when said car body is at a predetermined vertical position relative to said datum line, said actuating mechanism opening said valve assembly to permit fluid communication between said second outlet and said secondary suspension and said chamber in response to motion of said car body away from said truck and closing said valve assembly to prevent fluid communication between said second outlet and said secondary suspension and said chamber when said car body is at said predetermined vertical position relative to said datum line.

38. The railcar according to claim 37, wherein said piston is mounted on said car body and said valve assembly is mounted on said chamber, said biasing element being positioned so as to bias said chamber and said valve assembly mounted thereon toward said car body.

39. The railcar according to claim 38, wherein said cylinder, said piston and said biasing element are sized to effect motion of said chamber and said valve assembly mounted thereon toward and away from said car body in proportion to motion of said truck on said primary suspension away from and toward said wheels respectively.

40. The railcar according to claim 38, wherein said cylinder, said piston and said biasing element are sized to effect motion of said chamber and said valve assembly mounted thereon toward and away from said car body over a distance approximately equal to motion of said truck on said primary suspension away from and toward said wheels respectively.

41. The railcar according to claim 37, further comprising a bolster positioned between said truck and said secondary suspension, said actuating mechanism comprising a lever extending between said valve assembly and said bolster.

42. The railcar according to claim 38, wherein said compensating device further comprises:

a shroud mounted on said car body, said shroud surrounding said chamber, said piston and said valve assembly;

a first duct positioned within said shroud, said first duct having a first duct inlet connected in fluid communication with said source of pressurized fluid, and a first duct outlet in fluid communication with said first inlet of said valve assembly;

a second duct positioned within said shroud, said second duct having a second duct inlet in fluid communication with said secondary suspension and a second duct outlet in fluid communication with said second inlet of said valve assembly and said chamber.

43. A compensating device for controlling a vertical position of a car body of a railcar relative to a datum line, said railcar having a source of pressurized fluid, a truck with a plurality of wheels, a primary suspension positioned between said wheels and said truck, and a fluid pressurized secondary suspension positioned between said truck and a bolster, said bolster attached to said car body, said compensating device comprising:

a chamber in fluid communication with said secondary suspension;

a piston positioned within said chamber, said piston and said chamber being movable relatively to one another;

a biasing element positioned between said piston and said chamber;

a valve assembly mounted on one of said piston and said chamber, the other of said piston and said chamber being mounted on said bolster, said valve assembly having a first inlet in fluid communication with said source of pressurized fluid, a first outlet in fluid communication with said secondary suspension and said chamber, a second inlet in fluid communication with said secondary suspension and said chamber, and a second outlet;

an actuating mechanism extending between said valve assembly and said truck, said actuating mechanism opening said valve assembly to permit fluid communication between said pressurized source of fluid and said chamber and said secondary suspension in response to motion of said car body toward said truck, and closing said valve assembly to prevent fluid communication between said source of pressurized fluid and said chamber and said secondary suspension when said car body is at a predetermined vertical position relative to said datum line, said actuating mechanism opening said valve assembly to permit fluid communication between said second outlet and said secondary suspension and said chamber in response to motion of said car body away from said truck and closing said valve assembly to prevent fluid communication between said second outlet and said secondary suspension and said chamber when said car body is at said predetermined vertical position relative to said datum line.

44. The compensating device according to claim 43, wherein said piston is mounted on said bolster and said valve assembly is mounted on said chamber, said biasing element being positioned so as to bias said chamber and said valve assembly mounted thereon toward said car body.

45. A compensating device for controlling a vertical position of a car body of a railcar relative to a datum line, said railcar having a source of pressurized fluid, a truck with a plurality of wheels, a primary suspension positioned between said wheels and said truck, and a fluid pressurized secondary suspension positioned between said truck and said car body, said compensating device comprising:

a chamber in fluid communication with said secondary suspension;

a piston positioned within said chamber, said piston and said chamber being movable relatively to one another;

a biasing element positioned between said piston and said chamber;

a valve assembly mounted on one of said piston and said chamber, the other of said piston and said chamber being mounted on said truck, said valve assembly having a first inlet in fluid communication with said source of pressurized fluid, a first outlet in fluid communication with said secondary suspension and said chamber, a second inlet in fluid communication with said secondary suspension and said chamber, and a second outlet;

an actuating mechanism extending between said valve assembly and said car body, said actuating mechanism opening said valve assembly to permit fluid communication between said pressurized source of fluid and said chamber and said secondary suspension in response to motion of said car body toward said truck, and closing said valve assembly to prevent fluid communication between said source of pressurized fluid and said chamber and said secondary suspension when said car body is at a predetermined vertical position relative to said datum line, said actuating mechanism opening said valve assembly to permit fluid communication between said second outlet and said secondary suspension and said chamber in response to motion of said car body away from said truck and closing said valve assembly to prevent fluid communication between said second outlet and said secondary suspension and said chamber when said car body is at said predetermined vertical position relative to said datum line.

46. The compensating device according to claim 45, wherein said piston is mounted on said truck and said valve assembly is mounted on said chamber, said biasing element being positioned so as to bias said chamber and said valve assembly mounted thereon toward said car body.

47. A method of controlling a vertical position of a body mounted on a chassis of a vehicle relative to a datum line, said vehicle further including a plurality of wheels mounted on said chassis, a primary suspension positioned between said wheels and said chassis, and a fluid pressurized secondary suspension positioned between said chassis and said body, said method comprising:

using a valve assembly, actuated by motion of said valve assembly, to control flow of a pressurized fluid to and from said secondary suspension of said vehicle to move said body relative to said chassis;

moving said valve assembly along with said body on said secondary suspension relative to said chassis;

moving said valve assembly relatively to said body in proportion to motion of said chassis on said primary suspension relative to said wheels;

supplying said pressurized fluid to said secondary suspension through said valve assembly when said body is below said datum line; and venting said pressurized fluid from said secondary suspension through said valve assembly when said body is above said datum line.

48. A method of controlling a vertical position of a body mounted on a chassis of a vehicle relative to a datum line, said vehicle further including a plurality of wheels mounted on said chassis, a primary suspension positioned between said wheels and said chassis, and a secondary suspension positioned between said chassis and said body, said method comprising:

sensing a vertical motion of said body by moving a sensing device vertically along with said body;

moving said sensing device vertically, relative to said body, over a distance proportional to a vertical deflection of said primary suspension system;

sensing vertical motion of said sensing device over said distance proportional to said vertical deflection of said primary suspension system;

deriving said deflection of said primary suspension system from said moving of said sensing device proportional to said vertical deflection of said primary suspension system;

moving said body vertically in an opposite direction to said vertical motion of said body through a distance approximately equal to said vertical motion of said sensing device along with said body, plus said vertical deflection of said primary suspension system.

* * * * *